US006926273B1

(12) United States Patent
Vancura

(10) Patent No.: US 6,926,273 B1
(45) Date of Patent: Aug. 9, 2005

(54) SEAL CARD GAME AND METHOD

(75) Inventor: Olaf Vancura, Las Vegas, NV (US)

(73) Assignee: Mikohn Gaming Corporation, Las Vegas, NV (US)

( * ) Notice: Subject to any disclaimer, the term of this patent is extended or adjusted under 35 U.S.C. 154(b) by 37 days.

(21) Appl. No.: 10/808,836

(22) Filed: Mar. 25, 2004

(51) Int. Cl.[7] ..... A63F 3/06
(52) U.S. Cl. ..... 273/139; 273/138.1; 283/901; 283/903
(58) Field of Search ..... 273/139, 138.1, 273/269; 283/901, 903

(56) References Cited

U.S. PATENT DOCUMENTS 5,621,200 A * 4/1997 Irwin et al. ..... 235/375
5,855,514 A * 1/1999 Kamille ..... 463/17

OTHER PUBLICATIONS

"Big Grab Big Ticket Game", Frito-Lay, May 15, 1992.*

* cited by examiner

*Primary Examiner*—Benjamin Layno
(74) *Attorney, Agent, or Firm*—Dorr, Carson, Sloan, Birney & Kramer, P.C.

(57) ABSTRACT

A seal card game having a number of play areas, with each play area having a hidden symbol. One of the hidden symbols on the ticket is a directional symbol. The other hidden symbols are end of game symbols. The player has one opportunity to uncover a hidden symbol in only one play area. Uncovering an end of game symbol ends the game. Uncovering the directional symbol entitles the player to uncover one or more authorized award areas within a topological area. Upon redeeming the ticket, the player receives the authorized awards in the topological area based performance of a mathematical operation on values revealed in the authorized award areas.

15 Claims, 4 Drawing Sheets

SEAL CARD GAME AND METHOD

RELATED APPLICATIONS

This application is related to "PACHINKO STAND-ALONE AND BONUSING GAME WITH DISPLAYED TARGETS" filed Mar. 25, 2004, Ser. No. 10/809,260.

BACKGROUND OF THE INVENTION

1. Field of the Invention

The present invention relates to seal card games and, specifically, to scratch lottery tickets.

2. Statement of the Problem

Scratch lottery tickets are used principally by governmental entities to generate revenue therefor. A ticket is purchased at a retail establishment by a consumer upon payment of value such as $1.00, $2.00, $5.00, or $10.00. According to the instructions on the ticket, the consumer then scratches off a removable material from selected areas to reveal hidden play symbols on the ticket. When a win occurs, corresponding award area is scratched off to reveal a payoff value. The player takes the ticket to an establishment for redemption.

A pull ticket is used in the casino gaming world. Pull tickets require removing a cover member such as a top or a flap to reveal a hidden play symbol.

The term "seal card game" herein refers to scratch lottery tickets, to pull tickets, or to any other similar ticket.

A continuing need exists to provide new and exciting seal card games to consumers.

SUMMARY OF THE INVENTION

Solution to the Problem

The present invention meets the continuing need set forth above by providing a new and exciting seal card game.

Summary

A seal card game is played on a ticket that has a number of play areas. Each play region has hidden symbols under play areas. Only one of the hidden symbols on the ticket is a directional symbol. The other hidden symbols are end of game symbols. The player has only one opportunity to uncover (such as by scratching to remove material to reveal) a hidden symbol in one play area. Uncovering an end of game symbol ends the game. Uncovering the directional symbol entitles the player to continue play and to uncover a number of authorized award areas located within a topological area in an award region on the ticket. Upon redeeming the ticket, the player receives the authorized awards in the topological area based on a predetermined mathematical operation.

DETAILED DESCRIPTION OF THE INVENTION

Figure 1:
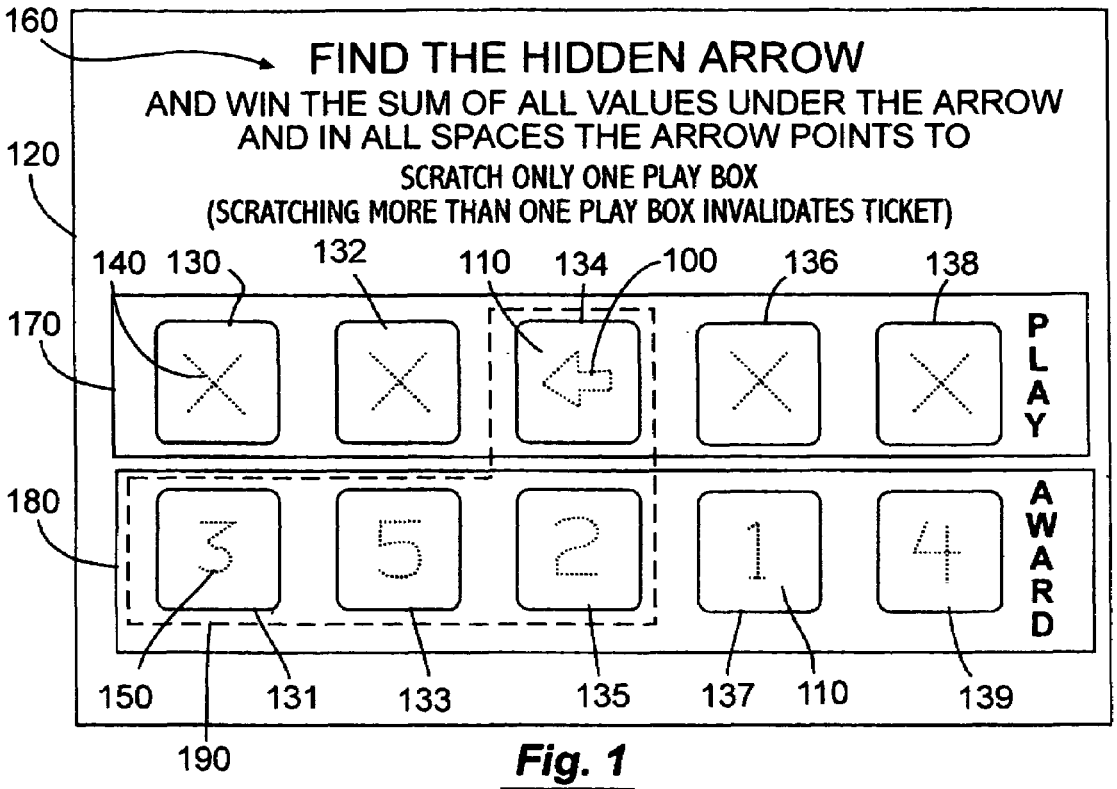
FIG. 1 sets forth a planar view of a seal card in the form of a scratch lottery ticket of the present invention.
Figure 2:
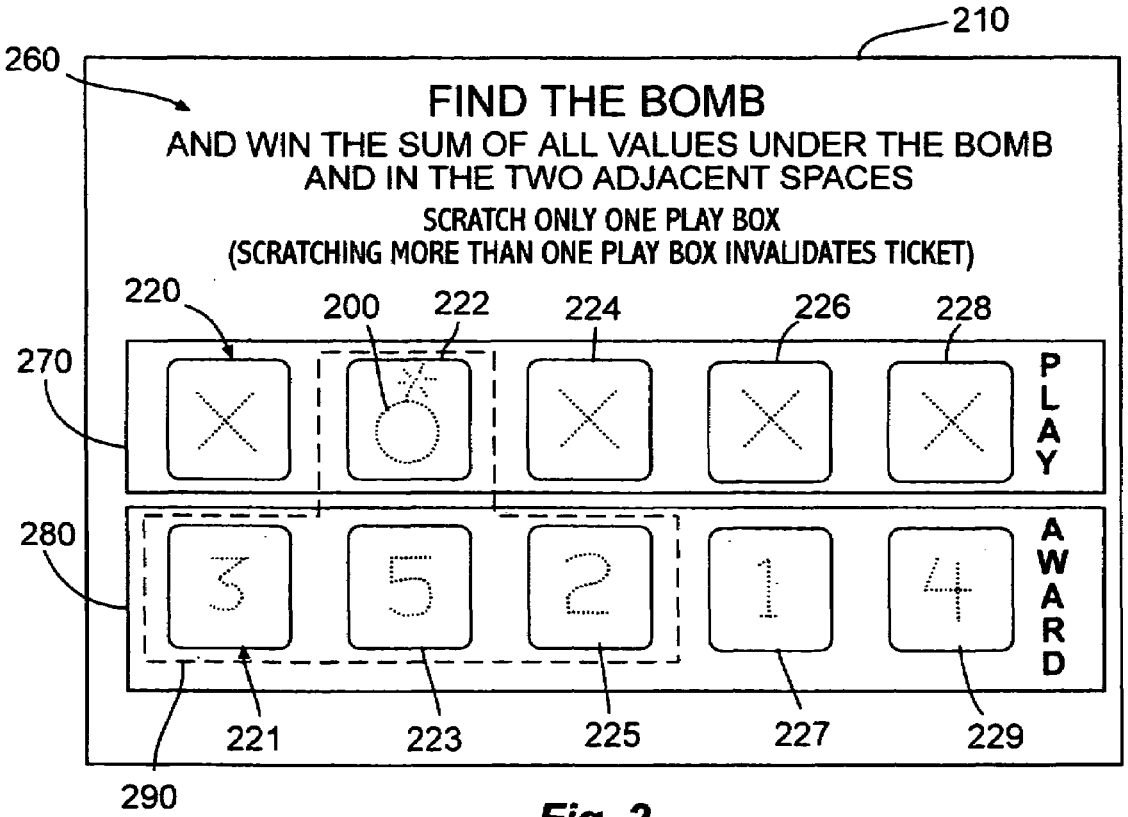
FIG. 2 is a planar view of a seal card in the form of a scratch ticket variation of the embodiment of FIG. 1.

In FIGS. 1 and 2 are shown scratch lottery tickets according to a number of embodiments of the present invention. The following applies to pull tickets and to all types of seal card games.

In FIG. 1, a directional symbol in the form of an arrow 100 is hidden below conventional removable material 110 of a scratch lottery ticket 120. Each of the five scratch play areas 130, 132, 134, 136, 138 in the play region 170 is covered with the removable material 110 that can be scratched by a player to reveal a hidden symbol such as arrow 100 or an "X" 140. Below each scratch play area is a corresponding scratch award area 131, 133, 135, 137, and 139 in an award area 180 also covered with removable material 110. Each scratch award area has a hidden value 150 (usually denominated in dollars). A set of instructions 160 are found on the ticket 120.

In play of the scratch lottery game of FIG. 1, the player can only scratch one of the play areas 130, 132, 134, 136, and 138 in play region 170. Scratching more than one play area would invalidate (or void) the ticket 120. If the player scratches a play area that does not contain the arrow 100, the game ends, as the player will have revealed an end-of-game symbol such as "X" 140. The symbol "X" 140 could be a phrase such as "GAME OVER," a symbol such as a STOP SIGN, a blank, etc.

If the player scratches a play area such as 134 to reveal a directional symbol such as arrow 100 then the player would win the hidden value in the scratch award area 135 under the arrow ($2.00) as well as the hidden values under areas 131 and 133 ($3.00 at 131 and $5.00 at 133) which would be also revealed by scratching. Hence, in this example, the player wins $10.00. The directional symbol 100 authorizes the player to reveal the award areas of 131, 133 and 135 in a topological area 190, and to be awarded an amount of money corresponding to the sum of the values illustrated in the revealed award areas. Area 190 is shown including play area 134 and the award areas 131, 133, 135 corresponding thereto. However, it will be appreciated that other groupings of play areas and associated award areas are possible under the teachings of the present invention.

Under the teachings of the present invention, revealed values 150 could be monetary values, such as dollars, a multiplier or a divider (or any other mathematical operation), a free ticket, etc. The values can also be zero or negative. For example, in FIG. 1, the authorized areas have an authorized award set of {$3.00, $5.00, $2.00} and the predetermined mathematical operation is summation, thereby resulting in an award of $10.00. In another example, assume the revealed value is the set of {$3.00, $5.00, 2X} which results in a payment of $3.00 plus $5.00 equals $8.00 times two, or $16.00. In a variation, rather than having a set of values printed on the ticket, a phrase such as "free ticket" could be printed on the ticket which would entitle the player to redeem the played ticket for a free ticket. Another award set such as {$0.00, −$1.00, $5.00} results in an award of $4.00. Yet another award set such as {−$2.00, $4.00, x3} results in an award of $6.00.

The arrow 100 could be randomly placed in any of the five scratch play areas 130, 132, 134, 136 or 138 in play region 170. The arrow is also randomly oriented to point in either direction. For example, if the arrow is in play area 130 and points in the direction opposite to play areas 132, 134, etc. (i.e., points to the left in FIG. 1), only the authorized award area 131 directly underneath would be scratched. On the other hand, if the arrow were placed in play area 130 and points towards the remaining play areas (i.e., pointing to the right in FIG. 1), the player would receive an award based upon the values in all award areas. Based upon the price of the ticket, based on the random placement, based upon the random orientation, and based on the values awarded, the probabilities can be controlled by the manufacturer of the present invention to provide a profitable return to the sponsor. There is no skill involved by the player in this game, as the player can only select one play area, and the likelihood of the player selecting a play area containing an arrow is purely a matter of chance.

FIG. 2 shows the implementation of a bomb graphic 200 on a lottery ticket 210. Scratching any scratch play area other than scratch play area 222, in play region 270, to reveal the "X" would result in no award. However, if only the scratch play area 222 containing the bomb 200 is scratched, then the player would scratch the award area 223 directly under the bomb 200 and the two adjacent award areas 221 and 225 located on either side. In the example of FIG. 2, the player would scratch area 223 to reveal $5, then area 225 to reveal $2, then area 221 to reveal $3 to win an award of $10.00. The directional symbol 200, as explained in instructions 260, authorizes revealing the award areas 221, 223 and 225. A topological area 290 contains the authorized award areas. The order of scratching these authorized areas is immaterial. It doesn't matter if all of the award areas 221, 223, 225, 227 and 229 in award region 280 are scratched. However, the player must not have scratched more than one of the play areas 220, 222, 224, 226, and 228 as to do so invalidates the ticket.

In the above two examples of a directional arrow 100 and bomb 200, a graphic is displayed. Any suitable graphic depiction can be used as a directional symbol. The directional symbol defines, per the printed instructions, the topological area of authorized award areas to be uncovered to reveal values 150. The term "directional symbol" herein encompasses the arrow 100, the bomb 200, and other symbols that function as described. When a directional symbol is revealed, a predetermined mathematical operation is performed on values revealed within topological area 290 to calculate the award to the player. In the case of the arrow 100 of FIG. 1, the mathematical operation is the summation of the numerical values displayed in topological area 190. In the case of a bomb 200 in FIG. 2, the mathematical operation is the summation of authorized values in topological area 290. Various predetermined mathematical operations may be performed on the values within the topological area, in connection with arrow 100, bomb 200, and/or other directional symbols appearing in play regions 170 or 270 including summation, multiplication, subtraction, division, and/or other mathematical operations. Any suitable directional symbol could be utilized under the teachings of the present invention. Any number of play areas and corresponding award areas can be used. Preferably, there is a one-to-one correspondence between play and award areas, but that is not necessary.

It is to be understood that while the play areas in FIGS. 1 and 2 are shown linearly on the ticket, they can be located anywhere, such as in opposing corners or away from each other as discussed next. This spacing between the play areas has an advantage in that it minimizes the possibility of a player inadvertently scratching (and thereby invalidating) another play area. At the point of redemption, any perceived tampering or uncovering of two (or more) play areas would cause the ticket to be voided and not paid.

Figure 3:
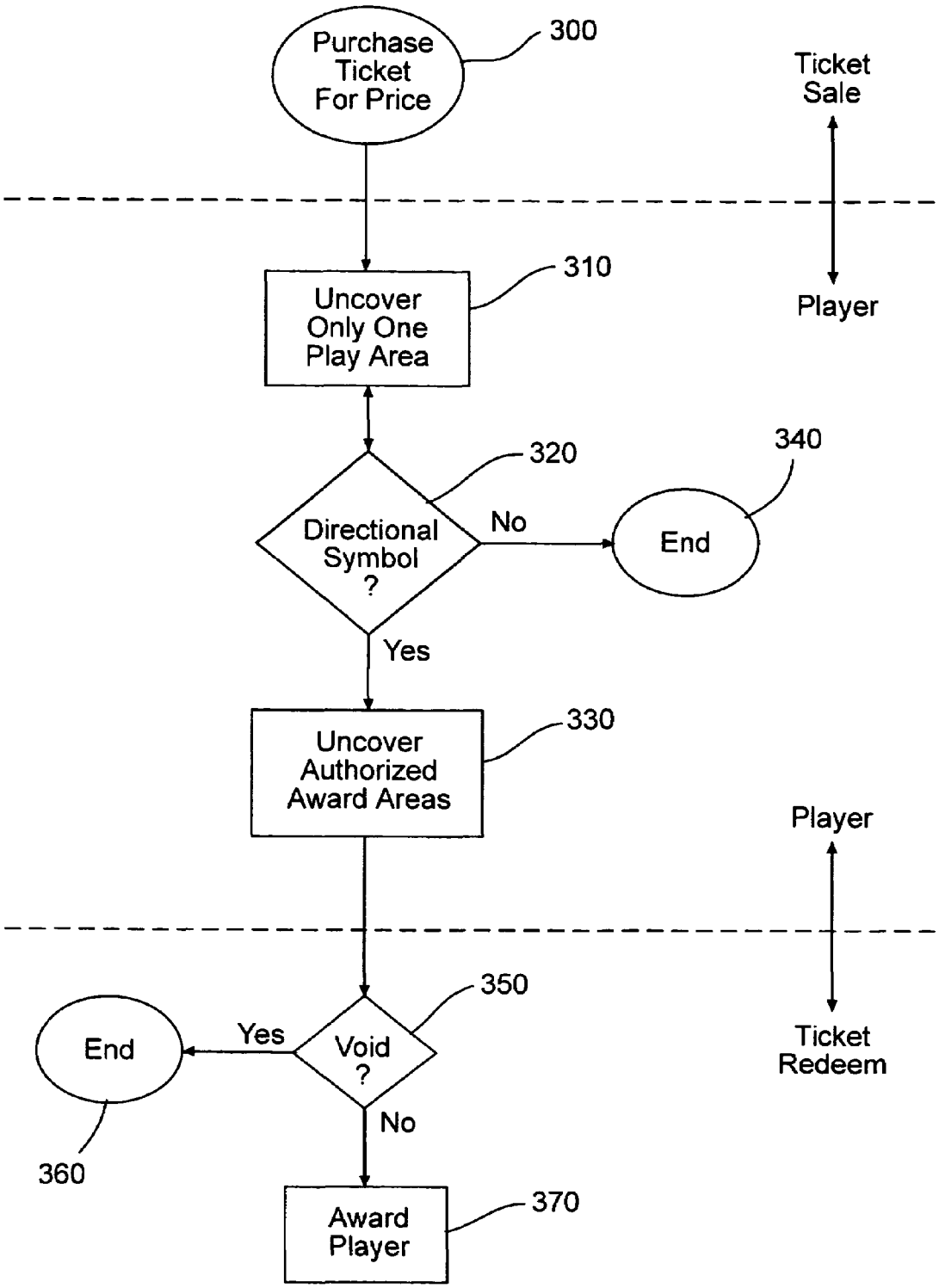
FIG. 3 is a method flow chart for play of the seal card game of the present invention.
Figure 4:
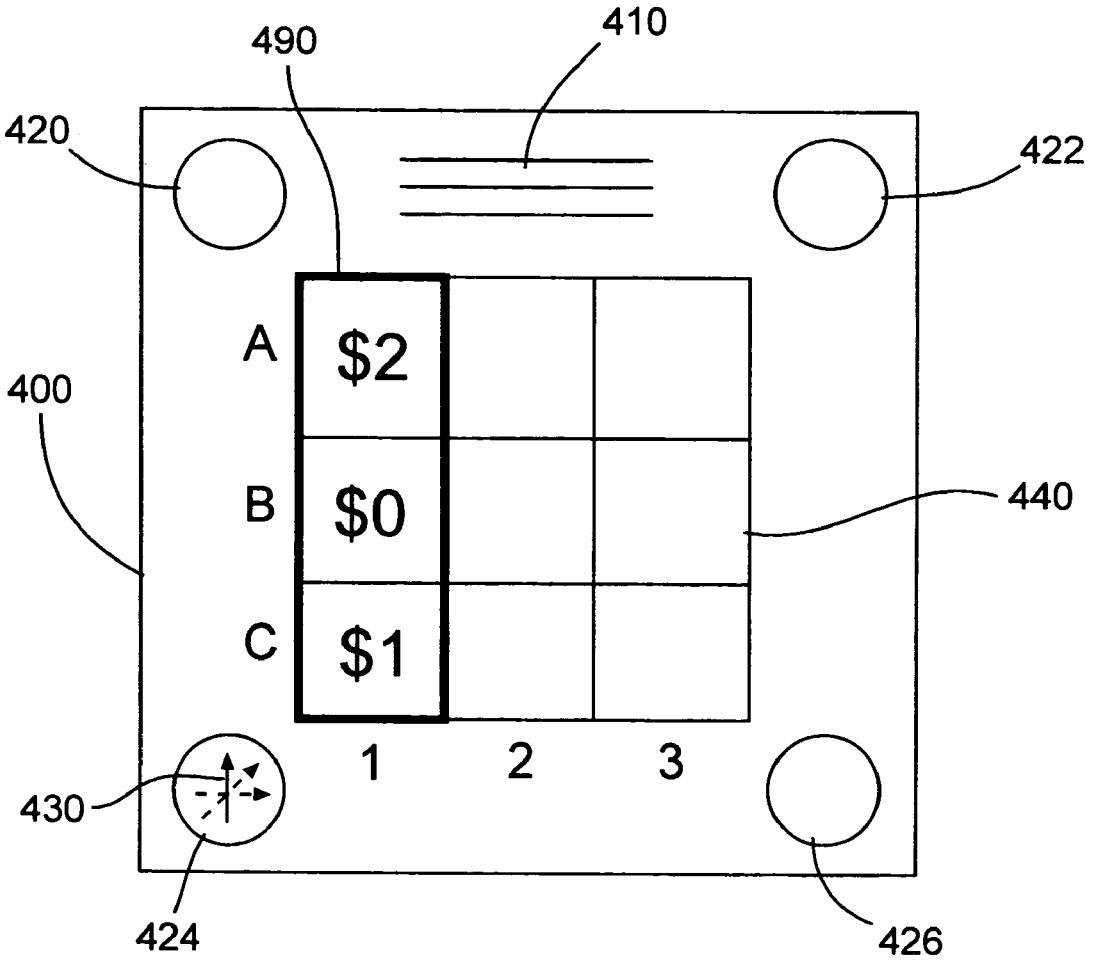
FIG. 4 is a planar view of a seal card according to another embodiment of the present invention.

In FIG. 4, a ticket 400 is shown to have instructions 410. The ticket 400 has four play positions 420, 422, 424 and 426. The positioning of these play positions is such as to minimize accidental scratching of other play areas so as not to void the ticket 400. The player selects one of the four play positions to scratch as discussed above. Only one of the play positions has a directional arrow. The remaining play positions do not. As shown in FIG. 4, by way of illustration, at play position 424, three arrows are shown. The arrow 430 points up (or optionally as shown by dotted lines across or diagonally). In FIG. 4, when the player uncovers play position 424 an arrow 430 is uncovered, the arrow 430 pointing upward, thereby informing the player to uncover authorized award positions in column "1" of award region 440. The topological area including the authorized award positions is shown in bold as 490. As shown in FIG. 4, the authorized awards uncovered are a set of values: {$1.00, $0.00, $2.00}. So, the player is paid $3.00. It is to be expressly understood that the arrow 430 could optionally point diagonally, thereby authorizing award areas C1, B2 and A3, or horizontally, thereby authorizing award areas in row C. The order of steps in FIG. 3 can vary. For example, a player may scratch off all award areas in an award region first as this is actually immaterial to the present invention. Those authorized awards exist in the topological area authorized by the directional symbol and explained by the instructions.

Figure 5:
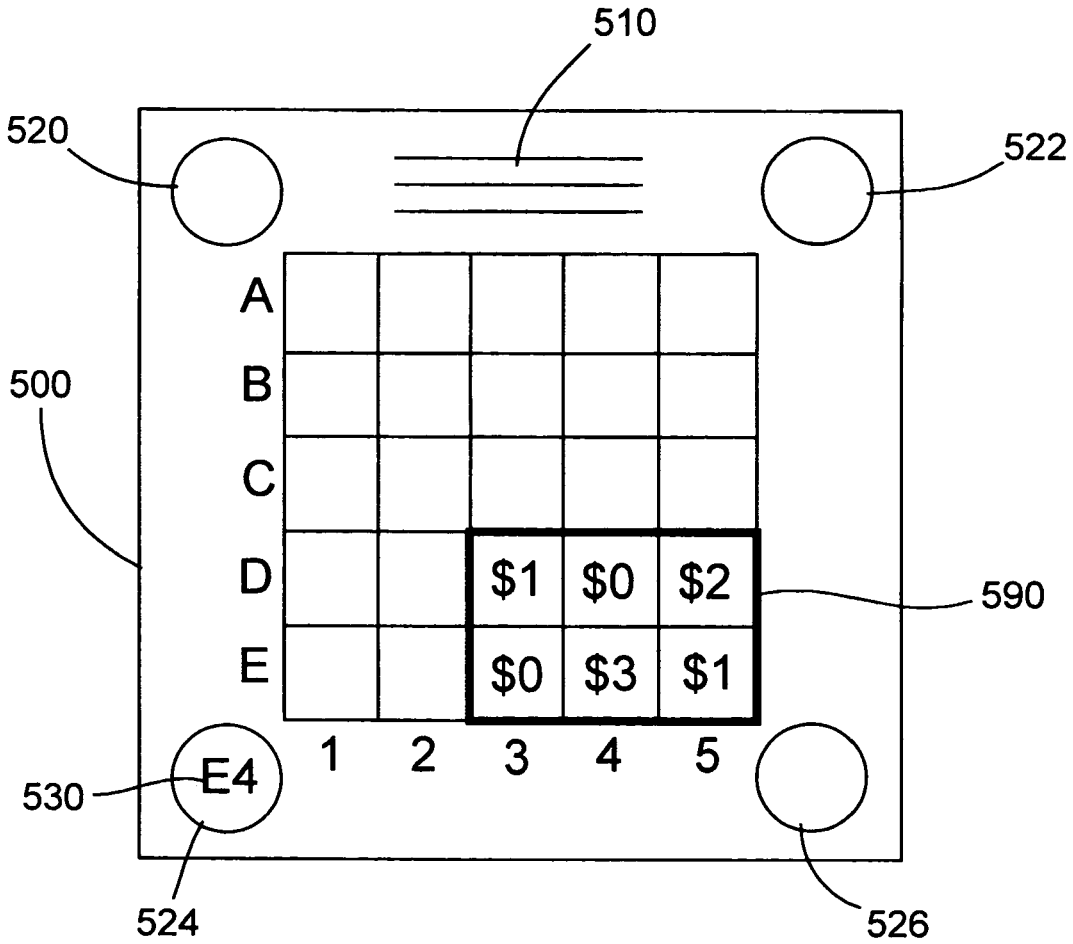
FIG. 5 is a planar view of a seal card according to yet another embodiment of the present invention.

In FIG. 5, another embodiment is set forth wherein the play position 524 of ticket 500 contains a directional symbol 530 which directs the player to award area E4. The instructions 510 inform the player that the authorized award areas are E4 and all areas adjacent thereto, so that the set of authorized award areas would be {E3, E4, E5, D3, D4, D5} as shown by topological area 590. The payout set for the above-identified award areas is {$0.00, $3.00, $1.00, $1.00, $0.00, $2.00} for a payout of $7.00.

What is described above in FIGS. 1 and 2 is a scratch lottery ticket having a plurality of scratch play areas in a play region wherein one of the scratch play areas has a directional symbol such as arrow 100 or bomb 200. The directional symbol directs the player, based on information contained on the ticket, to scratch award areas in a topological area to be scratched and uncovered. The authorized award areas are to be scratched pursuant to the instructions on the ticket pertaining to the directional symbol. A predetermined mathematical operation is performed on the revealed values to calculate a resulting monetary award to the player.

In FIG. 3, the method of the present invention is set forth. At, typically, a retail establishment for a scratch lottery ticket or a casino for pull-tab ticket, a ticket sale 300 takes place. A player purchases the ticket for a price. The value paid for the ticket corresponds to a player of a casino gaming machine placing a wager.

After purchasing the ticket, the player in step 310 uncovers only one play area of the ticket. The player looks at the single uncovered play area, and in stage 320, a decision step occurs. If a directional symbol has been uncovered, play continues in step 330. If a directional symbol is not found, and another symbol such as an end game symbol is uncovered, then play of the game of the present invention ends at step 340.

When play continues in step 330, the player then proceeds to follow the instructions on the ticket pertaining to the directional symbol, and the player uncovers the authorized award areas to reveal values in the proper topological area of the ticket. It is to be understood that even if the player uncovers all of the award areas, the award to the player would still be based only on the award amounts present in the authorized award areas. Uncovering the other award areas, however, would not invalidate the ticket.

The player returns to an establishment to redeem the ticket. In step 350 the establishment, usually a store clerk, first looks at the play area to ascertain that only one play area has been uncovered. The revealing of any other play area or any other tampering with the removable material over another play area results in invalidation of the ticket in stage 360. If the redeemed ticket is in proper form, and only one play area is uncovered, the player is awarded monetary value in step 370 based upon the topological area and the mathematical operation performed on the displayed values.

It is to be understood that in one embodiment, once the player has uncovered a winning symbol (e.g., an arrow), then the actual award values need not be uncovered by the player. Rather, the potential award to be awarded may be encoded (e.g., bar-coded) on the ticket itself. So, the player could simply turn-in the winning ticket to a store clerk (with only the winning symbol scratched-off), and the clerk in turn would verify the ticket's veracity, and via bar-code scan determine the winning amount of the prize to be awarded. This type of bar-code scan may also be used, even if the player scratched off the award values, to verify that the revealed award matches that intended.

It is to be understood that while the foregoing examples are given in terms of purchase by the consumer, with cash prizes, other embodiments are possible. For example, the seal tickets could be given away as a promotion (e.g., at fast-food establishments) or with accompanying purchase (e.g., at a department store), with possible awards including food prizes and/or merchandise, perhaps in addition to monetary prizes.

The above disclosure sets forth a number of embodiments of the present invention described in detail with respect to the accompanying drawings. Those skilled in this art will appreciate that various changes, modifications, other structural arrangements and/or other embodiments could be practiced under the teachings of the present invention without departing from the scope of this invention as set forth in the following claims.

I claim:

1. A seal card game comprising:

a ticket, a plurality of play areas on the ticket, each of said plurality of play areas having a hidden symbol, only one said hidden symbol on said ticket being a directional symbol, the remaining hidden symbols being end of game symbols, a corresponding plurality of award areas on the ticket, each of the plurality of award areas containing a hidden value, an award provided on the ticket only when a play area is uncovered to reveal the hidden directional symbol, the award determined by uncovering authorized award areas in a topological area authorized by the directional symbol, the award based on a predetermined mathematical operation performed on values revealed in the uncovered authorized award areas.

2. The seal card game of claim 1 wherein the hidden directional symbol is a graphic depiction of an arrow.

3. The seal card game of claim 1 wherein the hidden directional symbol is a graphic depiction of a bomb.

4. The seal card game of claim 1 wherein the mathematical operation comprises summing the values in uncovered authorized award areas.

5. The seal card game of claim 1 wherein at least one of the values in the uncovered authorized award areas is a multiplier.

6. The seal card game of claim 1 wherein the ticket is a scratch lottery ticket.

7. The seal card game of claim 1 wherein the ticket is a pull ticket.

8. A method for playing a seal card game comprising:

providing a plurality of play areas on a ticket, each of the plurality of play areas having a hidden symbol, only one said hidden symbol on the ticket being a directional symbol, providing a plurality of award areas on the ticket, removing removable material over only one of said plurality of play areas to reveal the hidden symbol, removing removable material over the award areas in the plurality of award areas only as authorized when the directional symbol is revealed, paying an award based upon a revealed value in each uncovered authorized award area.

9. The method of claim 8 wherein the hidden symbol is a graphic depiction of an arrow.

10. The method of claim 8 wherein the hidden symbol is a graphic depiction of a bomb.

11. The method of claim 8 wherein the paid award is based on summing said values included in said revealed authorized award areas.

12. The method of claim 8 wherein at least one of the values in the revealed award areas is a multiplier.

13. The method of claim 8 wherein the ticket is a scratch lottery ticket.

14. The method of claim 8 wherein the ticket is a pull ticket.

15. A method for playing a sealed card game comprising:

purchasing a ticket containing the sealed card game upon payment of value by a player, uncovering, by the player, only one of a plurality of play areas on the ticket to reveal a hidden symbol, ending the sealed card game for the player when the uncovered hidden symbol on the ticket is an end of game symbol, uncovering, by the player, award areas in a topological area of the ticket authorized by the uncovered hidden symbol when the uncovered hidden symbol is a directional symbol, the uncovered authorized award areas revealing hidden values, awarding the player monetary value determined by performing a predetermined mathematical operation on the revealed hidden values, voiding the sealed card game when more than one play area is uncovered.

* * * * *